US011149597B2

(12) United States Patent
Fimml et al.

(10) Patent No.: US 11,149,597 B2
(45) Date of Patent: Oct. 19, 2021

(54) VALVE DRIVE FOR AN INTERNAL COMBUSTION ENGINE, INTERNAL COMBUSTION ENGINE COMPRISING SUCH A VALVE DRIVE, AND METHOD FOR OPERATING AN INTERNAL COMBUSTION ENGINE COMPRISING SUCH A VALVE DRIVE

(71) Applicant: MTU FRIEDRICHSHAFEN GMBH, Friedrichshafen (DE)

(72) Inventors: Wolfgang Fimml, Hörbranz (AT); Jonathan Lipp, Friedrichshafen (DE); Johannes Schalk, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 0 days.

(21) Appl. No.: 16/467,713

(22) PCT Filed: Dec. 11, 2017

(86) PCT No.: PCT/EP2017/082150
§ 371 (c)(1),
(2) Date: Jun. 7, 2019

(87) PCT Pub. No.: WO2018/108778
PCT Pub. Date: Jun. 21, 2018

(65) Prior Publication Data

US 2019/0368391 A1 Dec. 5, 2019

(30) Foreign Application Priority Data

Dec. 12, 2016 (DE) ..... 10 2016 224 754.9

(51) Int. Cl.
*F01L 9/02* (2006.01)
*F01L 9/14* (2021.01)
(Continued)

(52) U.S. Cl.
CPC ..... *F01L 9/14* (2021.01); *F01L 1/047* (2013.01); *F01L 13/04* (2013.01);
(Continued)

(58) Field of Classification Search
CPC ..... F01L 1/047; F01L 9/025; F01L 2013/105; F01L 2201/00; F01L 13/04; F02D 2041/0012
See application file for complete search history.

(56) References Cited

U.S. PATENT DOCUMENTS 6,843,971 B2 1/2005 Scaefer-Sindlinger
18,474,248 7/2013 Sun
(Continued)

FOREIGN PATENT DOCUMENTS

CN 103925037 B 9/2016
DE 4132500 A1 4/1993
(Continued)

*Primary Examiner* — Zelalem Eshete
(74) *Attorney, Agent, or Firm* — Lucas & Mercanti, LLP; Klaus P. Stoffel

(57) ABSTRACT

A valve drive for an internal combustion engine, including a gas exchange valve; a first mechanically driven drive mechanism; and a second drive mechanism connected to the gas exchange valve to move same. The first and second drive mechanisms connected via a hydraulic coupling device that has a pressure chamber, which can be relieved of pressure via a valve device and is designed to couple the drive mechanisms by hydraulic pressure and to decouple same in a pressure-relieved state. The valve device has two switch valves fluidically connected to the pressure chamber in parallel and via which the pressure chamber is relieved of pressure in the open state of at least one of the switch valves. The valve drive has a controller that actuates the switch valves in a delayed manner to provide a variable valve stroke of the gas exchange valve during a stroke movement.

8 Claims, 1 Drawing Sheet

(51) Int. Cl.

| | |
|---|---|
| ***F01L 1/047*** | (2006.01) |
| *F01L 13/04* | (2006.01) |
| *F01L 13/00* | (2006.01) |
| *F02D 41/00* | (2006.01) |

(52) U.S. Cl.
CPC ..... *F01L 2013/105* (2013.01); *F01L 2201/00* (2013.01); *F02D 2041/0012* (2013.01)

(56) References Cited

U.S. PATENT DOCUMENTS

| | | | |
|---|---|---|---|
| 2015/0369093 | A1 | 12/2015 | Leiber |
| 2016/0215661 | A1 | 7/2016 | Jiangsu |

FOREIGN PATENT DOCUMENTS

| | | | |
|---|---|---|---|
| DE | 102006024669 | A1 | 11/2007 |
| DE | 102013100632 | A1 | 7/2014 |
| DE | 102013220555 | A1 | 4/2015 |
| JP | S5937222 | A | 2/1984 |
| WO | 8501984 | A1 | 5/1985 |
| WO | 2014106689 | A1 | 7/2014 |

VALVE DRIVE FOR AN INTERNAL COMBUSTION ENGINE, INTERNAL COMBUSTION ENGINE COMPRISING SUCH A VALVE DRIVE, AND METHOD FOR OPERATING AN INTERNAL COMBUSTION ENGINE COMPRISING SUCH A VALVE DRIVE

CROSS-REFERENCE TO RELATED APPLICATIONS

The present application is a 371 of International application PCT/EP2017/082150, filed Dec. 11, 2017, which claims priority of DE 10 2016 224 754.9, filed Dec. 12, 2016, the priority of these applications is hereby claimed and these applications are incorporated herein by reference.

BACKGROUND OF THE INVENTION

The invention relates to a valve drive for an internal combustion engine, to an internal combustion engine having such a valve drive, and to a method for operating an internal combustion engine having such a valve drive.

A valve drive of the type mentioned here has at least one gas exchange valve and a first, mechanically driven, drive mechanism. The valve drive furthermore has a second drive mechanism that for repositioning the at least one gas exchange valve is connected to the latter. The first drive mechanism is operatively connected to the second drive mechanism by way of a hydraulic coupling installation, wherein the hydraulic coupling installation has a pressure chamber which is capable of being relieved of pressure by way of a valve installation, wherein the coupling installation under hydraulic pressure in the pressure chamber is specified for coupling the first drive mechanism to the second drive mechanism, and in the pressure-relieved state is specified for decoupling the first drive mechanism from the second drive mechanism. In order for the pressure chamber to be able to be relieved of pressure, a switch valve by way of which the pressure chamber in the opened state of the switch valve is capable of being relieved of pressure is fluidically connected to said pressure chamber. It is thus possible for a fully variable valve drive to be represented. The mechanically driven drive mechanism herein typically predefines a valve stroke curve which is implemented fully as a corresponding valve stroke of the gas exchange valve only when the pressure chamber is kept under hydraulic pressure during the entire profile of the valve stroke curve, wherein the coupling of the first drive mechanism to the second drive mechanism during the profile of the valve stroke curve can at least be partially cancelled by relieving the pressure chamber of pressure by way of the switch valve such that so-called sub-curves for the gas exchange valve can be represented, wherein later opening, a reduced stroke path and/or earlier closing of the gas exchange valve in relation to the predefined valve stroke curve can in particular be effected, for example.

In this design embodiment it is disadvantageous that the switch valve is difficult to be adapted to the operation of an internal combustion engine. This relates in particular to the selection of a suitable size of the switch valve for a specific internal combustion engine. It is demonstrated herein that to this extent a product calculated from a flow cross section and a coefficient of flow rate is particularly decisive in terms of the behavior of the switch valve. When said product is too low, the actuation of an outflow of hydraulic means from the pressure chamber is performed slowly, this resulting in flat flanks in terms of the valve stroke of the gas exchange valve, wherein said gas exchange valve consequently reacts in particular by way of excessive inertia. By contrast, when the product calculated from the flow cross section and the coefficient of flow rate is too high, a fast response of the gas exchange valve to actuation of the switch valve can indeed be effected, but high pressure pulses in the pressure chamber and ultimately oscillations which render the behavior of the valve drive uncontrollable and unpredictable arise instead. This is compounded in that a dedicated switch valve has to be developed for each construction series, construction size and/or performance class of an internal combustion engine, such that no interchangeable parts can be used in the production for dissimilar internal combustion engines.

SUMMARY OF THE INVENTION

The invention is based on the object of achieving a valve drive for an internal combustion engine, an internal combustion engine having such a valve drive, and a method for operating an internal combustion engine having such a valve drive, wherein the disadvantages mentioned do not arise.

The object is achieved in particular in that a valve drive of the type mentioned above is refined in that the valve installation has at least two switch valves which are fluidically connected in parallel to the pressure chamber and by way of which the pressure chamber in the opened state is capable of being relieved of pressure by at least one of the switch valves, wherein the valve drive has a control apparatus which, for representing a variable valve stroke of the at least one gas exchange valve during a stroke movement of the gas exchange valve, is specified for actuating the switch valves in a temporally offset manner. On account thereof, the product calculated from the flow cross section and the coefficient of flow rate can be enlarged in comparison to only one switch valve, wherein a temporally staged cross-sectional release can be contemporaneously performed such that pressure peaks and thus ultimately also pressure pulses and pressure oscillations in the pressure chamber can be minimized or eliminated. It is therefore possible for a large total opening cross section, in particular preferably larger than in the use of only one switch valve, to be provided and nevertheless for pressure pulses in the pressure chamber as well as the disadvantages associated therewith to be contemporaneously avoided. Steeper flanks of a real stroke curve for the gas exchange valve, in particular steeper valve closing flanks, can thus be achieved, this leading overall to more corpulent stroke curves.

Moreover, an interchangeable parts strategy for different construction series, construction sizes and performance classes of internal combustion engines becomes possible, in that, for example, only one switch valve is used in the case of comparatively small internal combustion engines, as is also commonplace to date, wherein two or else more switch valves can be used for comparatively large internal combustion engines, wherein the same switch valves can in particular be used for all internal combustion engines. This leads to a simplified design of the different internal combustion engines as well as to a reduction of procurement and logistics costs in the context of the switch valves.

An additional advantage lies in that the switch valves are present so as to be redundant such that the valve drive is still fully functional even when one of the switch valves fails. The full variability of the valve drive in this instance is indeed no longer present, but the still remaining functionality is sufficient for operating the internal combustion engine, in the sense of a limp-home function or an emergency function, up to next-possible servicing.

The gas exchange valve can in particular be an inlet valve or an outlet valve which is assigned to a combustion chamber of the internal combustion engine. The gas exchange valve is particularly preferably an inlet valve.

The first driving mechanism being mechanically driven means in particular that said first driving mechanism is not hydraulically driven. The first mechanically driven driving mechanism preferably has a direct mechanical operative drive connection to a valve drive, in particular to a camshaft. The first drive mechanism is thus particularly preferably cam-driven. The shape of an external circumferential face of a cam that interacts with the first drive mechanism herein defines the valve stroke curve below which sub-curves by means of the hydraulic coupling installation can be represented in the stroke path/time diagram of the gas exchange valve.

The first drive mechanism can also be referred to as a drive-side or cam-side driving mechanism, because the latter is operatively connected to the valve drive.

The second drive mechanism for repositioning the gas exchange valve is preferably mechanically connected to the latter, particularly preferably in a purely mechanical manner without any further hydraulic or non-mechanical couplings of any other type. The second drive mechanism can also be referred to as a gas-exchange-valve-side driving mechanism since the latter is directly connected to the gas exchange valve and to this extent is directly assigned to the latter.

The first driving mechanism preferably has a first piston which on one side delimits the pressure chamber of the hydraulic coupling installation, as well as a first piston rod that is connected to the piston. A cam of the valve drive preferably interacts with the first piston rod of the first driving mechanism. However, it is also possible that a deflection mechanism is interposed between the cam and the first piston rod. The deflection mechanism is preferably designed so as to be mechanical.

The second drive mechanism preferably also has a second piston which on another side that faces away from the first piston of the first drive mechanism delimits the pressure chamber of the hydraulic coupling installation, as well as a second piston rod that is connected to said second piston, wherein the second piston rod of the second drive mechanism is connected to the gas exchange valve preferably by way of an in particular mechanical deflection mechanism.

The control apparatus is in particular specified for actuating the switch valves during the stroke movement of the gas exchange valve in a temporally offset but temporally overlapping manner. The control apparatus is in particular specified for actuating the switch valve so as to open. The wording "during a stroke movement of the gas exchange valve" means in particular that the switch valves are actuated, preferably actuated so as to open, in a temporally offset but temporally overlapping manner in a same stroke movement of the gas exchange valve.

According to one refinement of the invention it is provided that the switch valves of the valve installation are configured so as to be of identical construction. Particularly low logistics costs and a minor development complexity results in particular in this case, because an interchangeable parts strategy can be used not only in terms of an internal combustion engine but in terms of different construction series, construction sizes and performance classes of internal combustion engines, as has already been explained.

According to one refinement of the invention it is provided that the switch valves are configured as high-speed valves, in particular as so-called high-speed solenoid valves (HSSV). Such valves can be very rapidly switched, wherein said valves have discrete switched positions, specifically in particular a closed position and an opened position. In the actuation of such a high-speed switch valve it is typically not possible for the switching speed to be influenced herein. Said high-speed switch valve can rather be only digitally switched. In the case of the valve drive proposed here, the temporal switching behavior of the valve installation can nevertheless be influenced in that the different switch valves are actuated in a temporally offset but overlapping manner. According to one refinement of the invention it is provided that the control apparatus is specified for varying the temporal offset between the actuation of the switch valves. In this way, it is in particular possible for the temporal behavior of the valve installation and thus ultimately also the stroke movement of the gas exchange valve to be influenced even when the individual switch valves can ultimately only be digitally actuated. The control apparatus herein is in particular specified for varying the temporal offset between the actuation of the switch valves that are assigned to a same valve installation. The variation of the temporal offset is preferably performed as a function of characteristic diagram. An optimal actuation of the valve installation and thus also an optimal stroke movement of the gas exchange valve can thus be chosen for every operating point of the internal combustion engine.

According to one refinement of the invention it is provided that an end stage for actuation is assigned to each of the switch valves. The end stage herein provides the necessary output for actuating and in particular actuating so as to open the switch valve assigned to said end stage, or the switch valves assigned to said end stage. An end stage herein is in particular understood to be an electronic installation for actuating a switch valve, said electronic installation being in particular specified for implementing a switching signal by way of the required actuating output for switching the switch valve, and for thus driving the switch valve.

According to one refinement of the invention it is provided that the valve drive has a plurality of gas exchange valves that are assigned to different combustion chambers of an internal combustion engine. At least one hydraulic coupling installation having a respective valve installation is preferably assigned to each combustion chamber herein. It is provided that a common end stage is in each case assigned to at least two, preferably exactly two, switch valves which are assigned to different combustion chambers, that is to say in particular different hydraulic coupling installations, wherein the gas exchange cycles of the different combustion chambers are temporally mutually separated. In this way, the number of end stages used for the valve drive does not have to be multiplied by virtue of the multiplication of the number of switch valves, since the fact that the gas exchange cycles of different combustion chambers of one internal combustion engine which has a plurality of combustion chambers are not temporally congruent is utilized in a smart manner. This means in particular that the gas exchange cycles of such combustion chambers do not mutually overlap. Two switch valves which are assigned to different combustion chambers are in each case particularly preferably actuated by a common end stage, wherein phases of the gas exchange cycles of the combustion chambers are mutually offset in relation to one another by half an operating cycle of the internal combustion engine, thus by 360° in terms of the angle of the crankshaft in the case of a four-stroke engine. When the end stage emits an actuation signal, both switch valves assigned to the end stage are actuated. However, this actually leads to a variation of the valve stroke only in the case of one of the gas exchange valves that are assigned to the switch valves, since only one of the gas exchange valves by way of the first driving mechanism assigned thereto is actually initiated to perform a stroke movement, while the other gas exchange valve is momentarily inactive. In the case of the valve drive proposed here, double the number of switch valves can therefore be in particular actuated using the same number of end stages as in a conventional valve drive. To this extent, no additional costs arise in conjunction with the valve drive proposed here.

The object is also achieved in that an internal combustion engine which has a valve drive according to one of the exemplary embodiments described above is achieved. The advantages which have already been explained in the context of the valve drive are in particular derived in the context of the internal combustion engine.

In particular when the temporal offset between the actuation of the switch valves that are assigned to the same valve installation can be varied as a function of a characteristic diagram, the pressure amplitudes and thus ultimately the valve stroke of the gas exchange valves are capable of being actively influenced across an entire range of the characteristic diagram of the internal combustion engine.

According to one refinement of the invention it is provided that the internal combustion engine has a plurality of combustion chambers, wherein each combustion chamber is assigned at least one gas exchange valve as well as at least one hydraulic coupling installation of the valve drive. Each combustion chamber is preferably assigned at least one inlet valve and at least one outlet valve, wherein each inlet valve is particularly preferably assigned one hydraulic coupling installation of the valve drive. Alternatively or additionally, it is however also possible for the outlet valves to be in each case assigned one hydraulic coupling installation. It is likewise possible for the combustion chambers to have in each case a plurality of inlet valves and/or outlet valves, in particular two inlet valves and two outlet valves.

The internal combustion engine is preferably configured as a reciprocating piston engine. It is possible for the internal combustion engine to be specified for driving an automobile, a truck, or a commercial vehicle. In the case of one preferred exemplary embodiment, the internal combustion engine serves for driving in particular heavy land vehicles or nautical vehicles, for example mining vehicles, trains, wherein the internal combustion engine is used in a locomotive or a motorcar, or ships. A use of the internal combustion engine for driving a defense-related vehicle, for example a tank, is also possible. One exemplary embodiment of the internal combustion engine is also preferably used in a stationary manner, for example for the stationary energy supply in an emergency-power operation, permanent-load operation, or the peak-load operation, wherein the internal combustion engine in this case preferably drives a generator. The stationary application of the internal combustion engine for driving auxiliary equipment, for example fire-fighting pumps on oil rigs, is also possible. The application of the internal combustion engine in the exploration sector of fossil raw materials and in particular fuels, for example oil and/or gas, is furthermore possible. A use of the internal combustion engine in the industrial sector or in the construction sector, for example in an item of construction equipment or a construction machine, for example in a crane or an excavator, is also possible. The internal combustion engine is preferably configured as a diesel engine, as a gasoline engine, as a gas engine to be operated with natural gas, biogas, special gas, or any other suitable gas. In particular when the internal combustion engine is configured as a gas engine, said internal combustion engine is suitable for use in a cogeneration plant for the stationary production of energy.

The object is finally also achieved in that a method for operating an internal combustion engine having a valve drive is achieved, said valve drive having at least one gas exchange valve as well as a first, mechanically driven, driving mechanism and a second drive mechanism that is connected to the at least one gas exchange valve, wherein the first drive mechanism is operatively connected to the second drive mechanism by way of a hydraulic coupling installation, wherein the hydraulic coupling installation has a pressure chamber which is capable of being relieved of pressure by way of a valve installation and which under hydraulic pressure is specified for coupling the first drive mechanism to the second drive mechanism, and in the pressure-relieved state is specified for decoupling the first drive mechanism from the second drive mechanism. The valve installation herein has at least two switch valves which are fluidically connected in parallel to the pressure chamber and by way of which the pressure chamber in the opened state is capable of being relieved of pressure by at least one of the switch valves. In the context of the method it is provided that the switch valves, for representing a variable valve stroke of the at least one gas exchange valve during a stroke movement of the gas exchange valve, are actuated, in particular actuated so as to open, in a temporally mutually offset manner, but in particular in a temporally overlapping manner. A valve drive as per one of the exemplary embodiments described above is preferably used in the context of the method. The advantages which have already been explained in the context of the valve drive and of the internal combustion engine are in particular derived in the context of the method.

According to one refinement of the invention it is provided that the temporal offset between the actuation of the switch valves is varied in particular as a function of the operating point and particularly preferably as a function of the characteristic diagram.

It is possible for the control apparatus of the valve drive to be an engine control unit of the internal combustion engine, or for the functionality of the control apparatus of the valve drive to be integrated in a control apparatus, in particular in the engine control unit, of the internal combustion engine. However, it is also possible for the valve drive to be assigned a separate control apparatus.

The method proposed here can be fixedly implemented in an electronic assembly, in particular a hardware, of the control apparatus. However, it is also possible for a computer program product which comprises instructions on the basis of which the method described here is capable of being carried out to run on the control apparatus. To this extent, a computer program product which has machine-readable instructions by virtue of which a method as per one of the embodiments described above is carried out when the computer program product runs on a computer installation, in particular on a control apparatus, is also preferred.

A data carrier which has such a computer program product is also preferred.

Furthermore, a control apparatus which has such a computer program product or on which such a computer program product runs is furthermore preferred.

The description of the valve drive as well as the internal combustion engine, on the one hand, and of the method, on the other hand, are to be understood as mutually complementary. Method steps which have been explicitly or implicitly described in the context of the valve drive and/or the internal combustion engine are, preferably individually or combined with one another, steps of a preferred embodiment of the method. Features of the valve drive and/or of the internal combustion engine which have been explained in the context of the method are, preferably individually or combined with one another, features of a preferred exemplary embodiment of the valve drive and/or of the internal combustion engine. The method is preferably distinguished by at least one method step which is necessitated by at least one feature of a preferred exemplary embodiment, or an exemplary embodiment according to the invention, of the valve drive or of the internal combustion engine. The internal combustion engine and/or the valve drive are/is preferably distinguished by at least one feature which is necessitated by at least one step of a preferred embodiment, or an embodiment according to the invention, of the method.

The invention will be explained in more detail hereunder by means of the drawing in which:

DETAILED DESCRIPTION OF THE INVENTION

Figure 1:
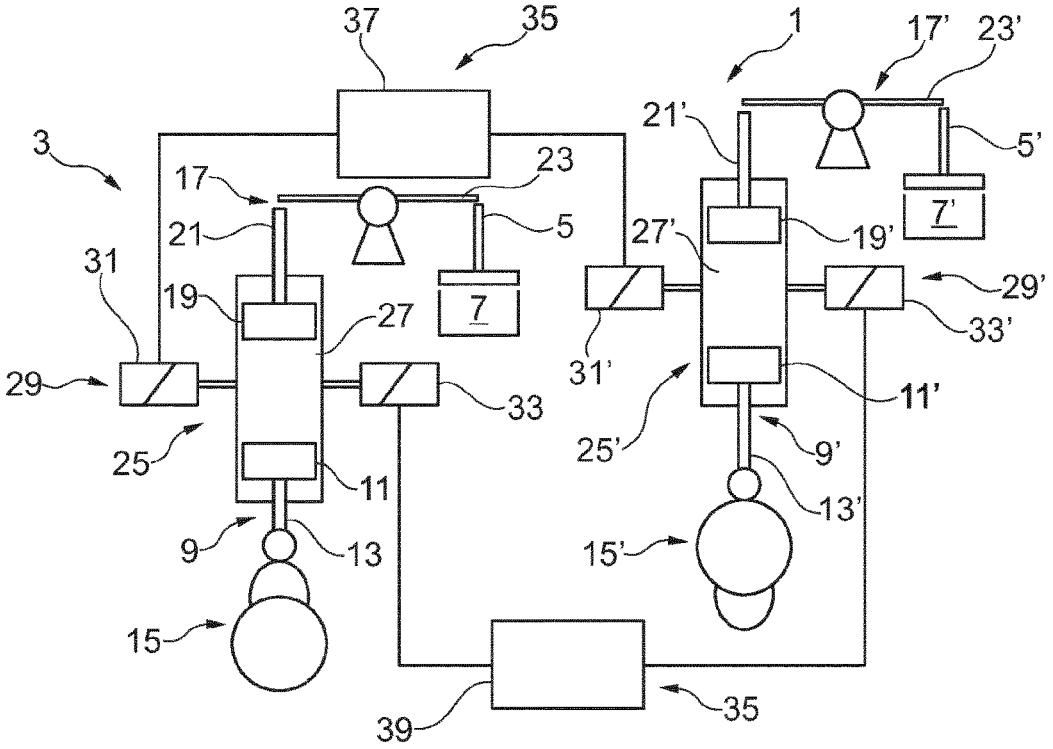
FIG. 1 shows a schematic illustration of an exemplary embodiment of an internal combustion engine having a valve drive.

FIG. 1 shows a schematic illustration of an exemplary embodiment of an internal combustion engine 1 having a valve drive 3. The valve drive 3 here is assigned plurality of gas exchange valves, in the schematic illustration two gas exchange valves 5, 5', said gas exchange valves 5, 5' in turn being assigned to different combustion chambers 7, 7' (likewise only schematically illustrated here) of the internal combustion engine 1.

The functioning mode of the valve drive 3 will first be explained in the context of the first gas exchange valve 5. Identical and functionally equivalent elements which are assigned to the second gas exchange valve 5' herein are provided with respective corresponding reference signs with an apostrophe, such that a separate explanation of said elements and the functioning mode thereof is not required; to this extent, reference is rather made to the explanation pertaining to the elements provided with reference signs without apostrophes. The interaction of the actuation of the different gas exchange valves 5, 5' in the case of the valve drive 3 will subsequently be explained in more detail.

The gas exchange valves 5, 5' are preferably configured as inlet valves. However, it is also possible for said gas exchange valves 5, 5' to be configured as outlet valves, or for the valve drive 1 to be assigned corresponding outlet valves in addition to the inlet valves 5, 5'. The internal combustion engine 1 preferably has more than two combustion chambers 7, 7'. The number of combustion chambers 7, 7' herein is not delimited in principle. The internal combustion engine 1 can in particular have four, six, eight, ten, twelve, sixteen, eighteen, twenty, or twenty-four, combustion chambers 7, 7'.

The first gas exchange valve 5 is assigned a first, mechanically driven, drive mechanism 9 which here has in particular a first piston 11 and a first piston rod 13, wherein the first piston rod 13 here is operatively connected to a cam 15 of a camshaft, the first piston rod 13 and thus the first piston 11 being contemporaneously activatable by said cam 15 so as to move in the manner of a stroke.

A second driving mechanism 17 which, for repositioning the gas exchange valve 5, is mechanically connected to the latter and which in particular has a second piston 19 and a second piston rod 21 is moreover provided, wherein said second driving mechanism 17 furthermore has a deflection mechanism 23 by way of which the second piston rod 21 is mechanically coupled to the gas exchange valve 5.

The first drive mechanism 9 and the second drive mechanism 17 are operatively connected to one another by way of a hydraulic coupling installation 25, wherein the hydraulic coupling installation 25 has in particular a pressure chamber 27 which by way of a valve installation 29 is capable of being relieved of pressure, wherein the pressure chamber 27, under hydraulic pressure, is specified for coupling the first drive mechanism 9 to the second drive mechanism 17, and to decouple said first drive mechanism 9 and said second drive mechanism 17 in the pressure-relieved state. To this end, the two pistons 11, 19 are collectively disposed in the pressure chamber 27 such that the second piston 19, when the pressure chamber 27 is under hydraulic pressure, follows a stroke movement of the first piston 11, in a manner transmitted by way of the hydraulic means, wherein the second piston 19 can be decoupled from the first piston 11 in that the pressure chamber 27 is relieved of pressure such that the coupling by way of the hydraulic means is cancelled, wherein the second piston 19 in this instance can no longer follow a stroke movement of the first piston 11.

A variable stroke for the gas exchange valves 5 can be correspondingly represented by way of the hydraulic coupling installation 25, wherein sub-curves in terms of a valve stroke curve that is defined by the shape of the cam 15 can in particular be obtained. The valve drive 3 is therefore configured as a variable valve drive 3 and in particular as a fully variable valve drive 3.

The valve installation 29 has at least two, here exactly 2, switch valves 31, 33 that are fluidically connected in parallel to the pressure chamber 27, specifically a first switch valve 31 and a second switch valve 33, wherein the pressure chamber 27 in the opened state is capable of being pressure-relieved by at least one of the switch valves 31, 33.

The valve drive 3 moreover has a control apparatus 35 of which only two end stages, specifically a first end stage 37 and a second end stage 39, are schematically illustrated here. The control apparatus 35, for representing a variable valve stroke during a same stroke movement of the gas exchange valve 5, is specified for actuating, in particular actuating so as to open, the switch valves 31, 33 in a temporally offset but preferably temporally overlapping manner.

Instead of a single switch valve by way of which the pressure chamber 27 is capable of being pressure-relieved, as is known in the case of conventional valve drives, said valve drive in the case of the valve drive 3 proposed here is accordingly assigned at least the two switch valves 31, 33, on account of which it becomes possible for a comparatively high flow cross section to be released and pressure in pulses in the pressure chamber 27 to be contemporaneously minimized, specifically in that a temporally staged release of the cross section in the form of the temporally offset actuation of the switch valves 31, 33 is carried out. Steeper valve stroke flanks, in particular steeper valve closing flanks, can thus be achieved for the gas exchange valve 5, on account of which overall more corpulent stroke curves result. Furthermore, a use of interchangeable parts is possible not only on the internal combustion engine 1 but also in the case of an entire construction series or in the case of different construction series, in particular different sizes or performance classes, of internal combustion engines 1, because the same switch valve for providing larger flow cross sections can be provided in multiples.

To this extent, it is in particular provided that the switch valves 31, 33 as well as the switch valves 31', 33' of the second gas exchange valve 5' are configured so as to be of identical construction.

The switch valves 31, 33, 31', 33' are preferably configured as high-speed valves, in particular as high-speed solenoid valves (HSSV).

The control apparatus 35 is preferably specified for varying the temporal offset between the actuation of the switch valves 31, 33, 31', 33' that are assigned to a same valve installation 29, 29', wherein the variation of the temporal offset can in particular be performed as a function of momentary operating point of the internal combustion engine 1, most particularly preferably as a function of a characteristic diagram. A suitable valve stroke curve and a dedicated suitable switching behavior of the switch valves 31, 33, 31', 33' can thus be represented for each operating point of the internal combustion engine 1.

Each of the switch valves 31, 33, 31', 33' is assigned an end stage 37, 39. For example, the first switch valves 31, 31' are assigned the first end stage 37, and the second switch valves 33, 33' are assigned the second end stage 39.

It is demonstrated herein that two switch valves 31, 31', 33, 33' which are assigned to different combustion chambers 7, 7' are in each case assigned a common end stage 37, 39, wherein the gas exchange cycles of the combustion chambers 7, 7' are temporally mutually separated. In the case of the combustion chambers 7, 7' illustrated here, it is to this extent in particular provided that the phases of operating cycles of said combustion chambers 7, 7' are mutually displaced by half an operating cycle period, thus by specifically 360° in terms of the angle of the crankshaft in the case of a four-stroke engine. Therefore, the respective two first switch valves 31, 31' which are assigned to the different gas exchange valves 5, 5' can be actuated by a common end stage, here specifically the first end stage 37, wherein the two second switch valves 33, 33' can likewise be actuated by another common end stage, here specifically by the second end stage 39 which is different from the first end stage 37. The switch valves 31, 33, 31', 33' of the respective same gas exchange valve 5, 5' herein are in each case actuated by different end stages 37, 39, such that the temporal offset in the actuation can be implemented. However, two switch valves 31, 31', 33, 33' that are in each case assigned to the different gas exchange valves 5, 5' herein share a common end stage 37, 39.

For example, when the first end stage 37 emits an actuation signal, the latter is received by the two first switch valves 31, 31', on upon which said two first switch valves 31, 31' are actuated so as to open. However, at the temporal point or crankshaft angle illustrated in FIG. 1, this leads only to an effect on the first gas exchange valve 5 since only the first drive mechanism 9 of the latter is momentarily mechanically activated by the first cam 15 such that the first gas exchange valve 5 is actuated to perform a valve stroke movement which can be varied by way of the actuation of the first switch valve 31. By contrast, the second cam 15' is in a position in which the latter does not effect any valve stroke movement of the second gas exchange valve 5' by way of the first drive mechanism 9' of the latter, such that the second gas exchange valve 5', independently of the switching behavior of the first switch valve 31' assigned to said second gas exchange valve 5', does not carry out any stroke movement. The actuation of the first switch valve 31' that is assigned to the second gas exchange valve 5', in addition to the actuation of the first switch valve 31 that is assigned to the first gas exchange valve 5, by the first end stage 37 thus does not develop any additional effect which is why it is possible for the two first switch valves 31, 31' to be actuated by way of the common first end stage 37.

The same applies in an entirely analogous manner to the second end stage 39 and to the second switch valve 33, 33'.

The end stages 37, 39 are activated in a temporally offset manner such that the respective first switch valves 31, 31' and the respective second switch valves 33, 33' are actuated so as to open in a temporally offset but preferably temporally overlapping manner.

Figure 2:
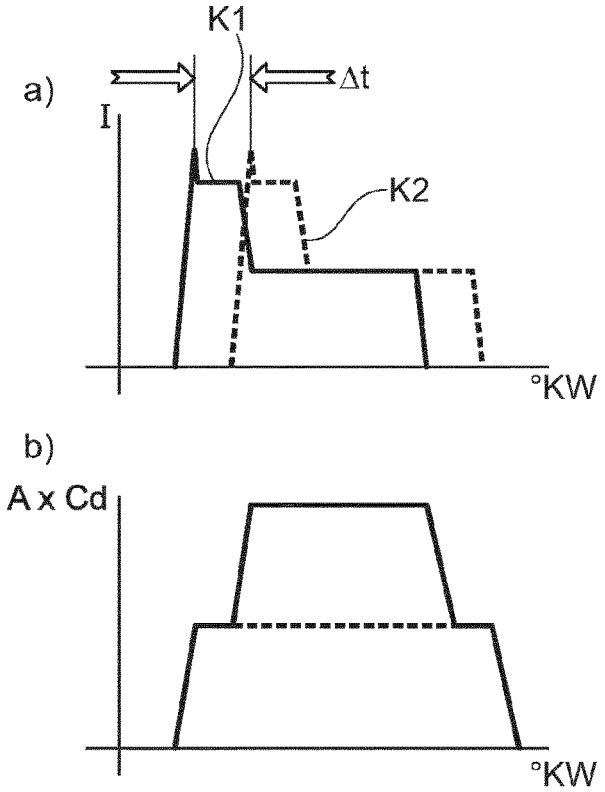
FIG. 2 shows a schematic illustration of the functioning mode of the valve drive according to FIG. 1.

FIG. 2 shows a diagrammatic illustration of the functioning mode of the valve drive 3 according to FIG. 1. At a) an actuation current I herein is schematically plotted in the diagram as a function of the camshaft angle of the internal combustion engine 1. The actuation current I for the first switch valves 31, 31' that is outputted by the first end stage 37 is illustrated as a solid first curve K1, wherein the actuation current I of the second end stage 39 for the second switch valves 33, 33' is illustrated as a dashed second curve K2. It is demonstrated herein that the first curve K1 and the second curve K2 temporally mutually overlap but have a mutual temporal offset Δt. Said temporal offset Δt is preferably variable, wherein said temporal offset Δt can preferably be chosen by the control apparatus 35 as a function of the operating point, in particular as a function of a characteristic diagram.

At b), the product calculated from a flow cross section A of the switch valves 31, 33 and a coefficient of flow rate Cd is plotted as a function of the camshaft angle of the internal combustion engine 1. It is demonstrated herein that the release of the flow cross sections of the individual switch valves 31, 33 behaves in additive manner by virtue of the temporally offset actuation of said switch valves 31, 33. The profile of the overall flow cross section release for the two switch valves 31, 33 which are actuated so as to open in a temporally offset but mutually overlapping manner, thus behaves exactly like the sum calculated from the respective flow cross-section releases for the individual switch valves 31, 33.

It is thus possible for the total flow cross section to be released in a temporally staged manner and for pressure pulses in the pressure chamber 27 to be contemporaneously minimized, preferably prevented.

The temporal offset Δt for the actuation of the switch valves 31, 33' herein can preferably be chosen such that pressure pulses created are interfered out of the way by virtue of the opening of the different switch valves 31, 33.

It is overall demonstrated that a very efficient and cost-effective potential for implementing a fully variable valve drive 3 having steep flanks while avoiding pressure pulses is achieved by way of the valve drive 3 proposed here, the internal combustion engine 1, and the method.

The invention claimed is:

1. A valve drive for an internal combustion engine, comprising:

at least one gas exchange valve;

a first, mechanically driven, drive mechanism;

a second drive mechanism connected to the at least one gas exchange valve for repositioning the at least one gas exchange valve;

a hydraulic coupling installation that operatively connects the first drive mechanism to the second drive mechanism, wherein the hydraulic coupling installation has a pressure chamber which is capable of being relieved of pressure and which under hydraulic pressure is specified for coupling the first drive mechanism to the second drive mechanism, and in a pressure-relieved state is specified for decoupling the first drive mechanism from the second drive mechanism;

a valve installation connected to the pressure chamber to relieve the pressure in the pressure chamber, wherein the valve installation has at least two switch valves which are fluidically connected in parallel to the pressure chamber and by way of which the pressure chamber in an opened state is capable of being relieved of pressure by at least one of the switch valves; and a control apparatus configured to actuate the switch valves in a temporally offset manner for representing a variable valve stroke of the at least one gas exchange valve during a stroke movement of the gas exchange valve, wherein the at least one gas exchange valve includes a plurality of gas exchange valves assigned to different combustion chambers of the internal combustion engine, wherein a common end stage of the control apparatus is in each case assigned to at least two of the switch valves that are assigned to different combustion chambers, said different combustion chambers having gas exchange cycles that are temporally mutually separated.

2. The valve drive according to claim 1, wherein the switch valves of the valve installation are of identical construction.

3. The valve drive according to claim 1, wherein the switch valves are high-speed valves.

4. The valve drive according to claim 1, wherein the control apparatus is configured to vary the temporal offset between the actuation of the switch valves.

5. An internal combustion engine comprising a valve drive according to claim 1.

6. The internal combustion engine according to claim 5, further comprising a plurality of combustion chambers, wherein each combustion chamber is assigned at least one gas exchange valve as well as at least one hydraulic coupling installation of the valve drive.

7. A method for operating an internal combustion engine having a valve drive according to claim 1, comprising the step of actuating switch valves that are fluidically connected in parallel to a common pressure chamber of a hydraulic coupling installation of the valve drive in a temporally mutually offset manner during a stroke movement of a gas exchange valve that is assigned to the hydraulic coupling installation.

8. The method according to claim 7, further including varying the temporal offset in the actuation of the switch valves.

* * * * *